United States Patent [19]

Bishop

[11] 4,423,680

[45] Jan. 3, 1984

[54] AUTOMATIC CONTACT INK STAMPING APPARATUS

[76] Inventor: Alva J. Bishop, 2270 Weiler Dr., Zanesville, Ohio 43701

[21] Appl. No.: 447,888

[22] Filed: Dec. 8, 1982

[51] Int. Cl.[3] ..... B41F 17/00; B41F 17/24

[52] U.S. Cl. ..... 101/318; 101/41

[58] Field of Search ..... 101/41, 44, 42, 43, 101/318, 316

[56] References Cited

U.S. PATENT DOCUMENTS

| | | | |
|---|---|---|---|
| 2,382,174 | 8/1945 | Rott | 101/41 |
| 3,877,367 | 4/1975 | Norwood | 101/44 |
| 4,060,031 | 11/1977 | Philipp | 101/41 X |
| 4,308,793 | 1/1982 | Schmidt | 101/41 X |

*Primary Examiner*—Clifford D. Crowder

*Attorney, Agent, or Firm*—Francis T. Kremblas, Jr.

[57] ABSTRACT

An automatic contact ink stamping apparatus for printing predetermined indicia particularly adapted for marking assembly lines parts or other objects which is characterized by a dual acting piston stroke assembly which is operatively attached to a stamp platen to move the platen between an inking position adjacent to an ink supply and a stamping position adjacent to the work piece. The stamp platen is mounted to a horizontal slide assembly which includes an opening having a pair of inclined walls. A vertically extending stem connected to the stamp platen is provided with bearing surfaces which cooperate with the inclined walls of the slide assembly and a cooperating carriage member to transfer a terminal portion of the horizontal stroke length of the piston into vertical displacement of the stamp platen at the respective ink supply and ink stamping stations.

3 Claims, 6 Drawing Figures

AUTOMATIC CONTACT INK STAMPING APPARATUS

BACKGROUND

There are many various types of ink stamping devices available for particular applications in industry including relatively expensive and sophisticated printers and the like.

In many assembly line type manufacturing applications various parts or subassemblies of parts produced in high volume require various repetitive indicia or markings, such as part identity numbers and the like.

One of the problems long encountered in such manufacturing lines is the lack of a highly reliable, adaptable, and yet reasonable cost contact ink stamping apparatus which is capable of high volume production. A further problem in seeking a satisfactory printer of this type is that the configuration and line of motion of the ink stamping device does not readily accomodate the often times crowded condition of the assembly line operation to permit easy installation of the stamping device in an already existing production line at an appropriate location.

Prior to the present invention, there has not been available a low profile printer having a horizontal piston stroke length which also provides a vertical stamping stroke in a relatively simple and inexpensive manner.

SUMMARY OF INVENTION

The present invention relates generally to high speed, high volume contact ink stamping devices which are particularly adaptable to various high volume production lines of parts and subassemblies. In particular, the present invention relates to a vertically compact or low profile ink stamping device which incorporates a horizontally disposed piston to move the stamping platen between horizontally displaced ink filling and ink stamping position as well as means to effect a vertical stroke to the platen at each such position.

The ink stamping device of the present invention also incorporates an easy fill ink supply and a readily removable ink stamping platen to provide for very effective and efficient adaption to changing indicia. The low profile configuration and the one piston assembly are also designed for economical manufacture and is readily adaptable for installation in a variety of locations within a given production line.

The ink stamping assembly is mounted to a slide member which in turn is mounted within a carriage member incorporating a stop limiting horizontal travel of the slide plate. The slide member within the carriage is provided with an opening for receiving an upper portion of a stem connected to a stamping platen. The opening in the slide member includes inclined surfaces which cooperate with the upper end of the stem to effect transfer of the horizontal motion of the drive piston into vertical motion of the ink platen at the ink supply station and at the stamping station.

OBJECTS

It is therefore an object of the present invention to provide an ink stamping apparatus particularly useful for high volume, high speed applications which incorporates a vertically compact configuration.

It is another object of the present invention to provide an apparatus of the type described which incorporate a single horizontal piston stroke to effect both a horizontal and a vertical displacement of the ink stamping platen.

It is another object of the present invention to provide an apparatus of the type described which is readily adaptable to changing the ink stamping platen in a very easy manner.

It is a further object of the present invention to provide an apparatus of the type described which is very reliable and easily maintained and yet is incorporated in a simple and economical structure.

Further objects and advantages of the present invention will be apparent from the following description, reference being had to the accompanying drawings wherein a preferred form of embodiment of the invention is clearly shown.

IN THE DRAWINGS

DETAILED DESCRIPTION

Figure 2:
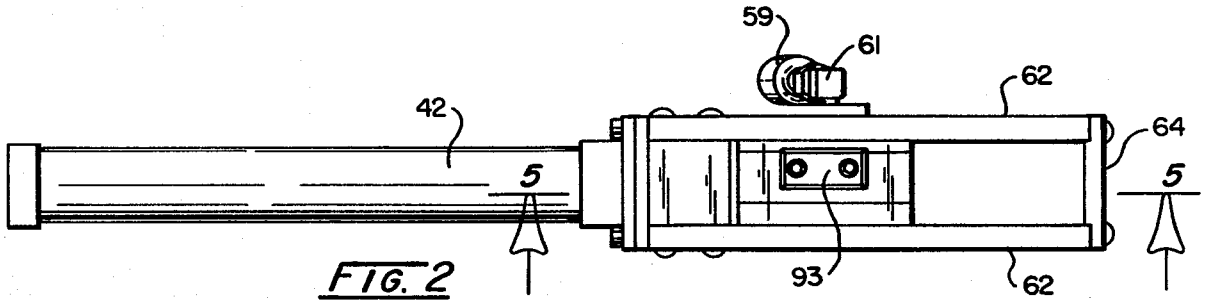
FIG. 2 is a top plan view of the apparatus shown in FIG. 1.
Figure 1:
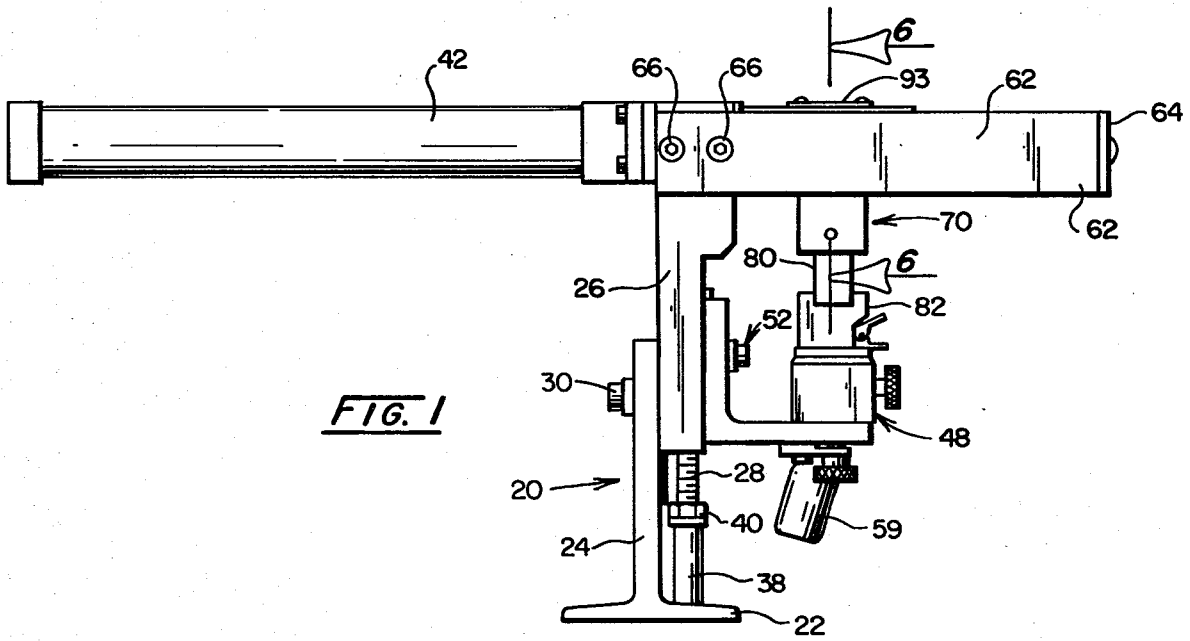
FIG. 1 is a front elevational view of an automatic ink stamping apparatus constructed in accordance with the present invention.

FIGS. 1 and 2 illustrate an ink stamping apparatus constructed in accordance to the present invention and includes a mounting base means 20 which may be fixed by any conventional means to a support base, not shown, adapted to any particular application. Base means 20 includes a foot portion 22 and a vertical frame portion 24.

Figure 5:
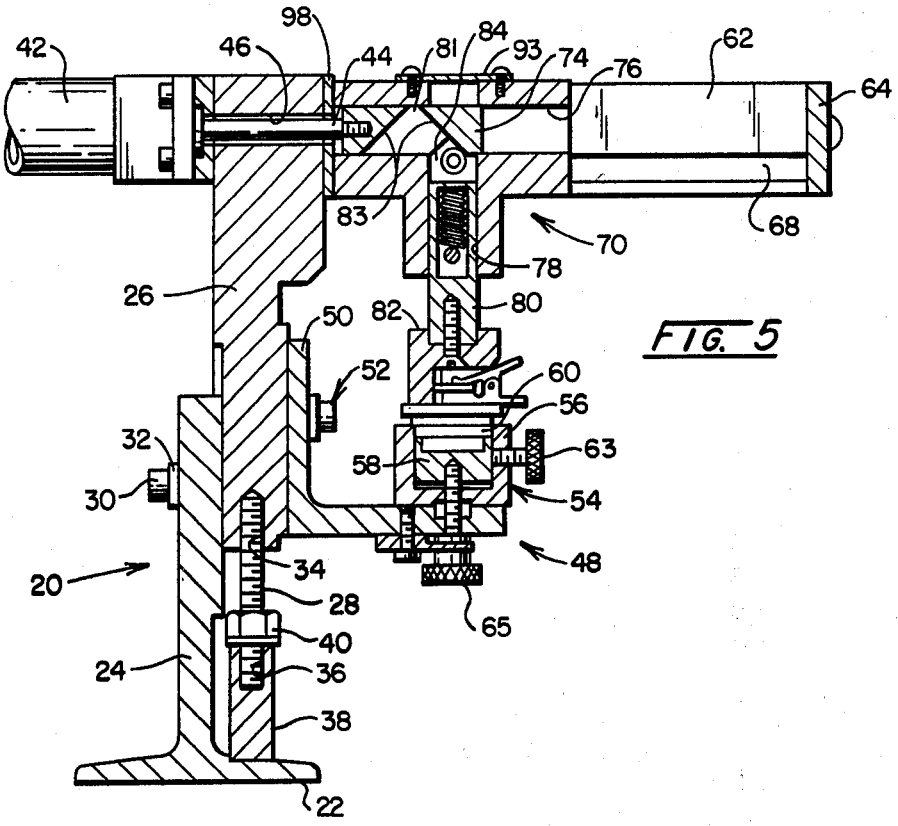
FIG. 5 is a side sectional view of the apparatus of the preceding Figures, the section being taken along line 5—5 in FIG. 2.

As best seen in FIG. 5, a vertically extending support frame 26 is movably mounted to vertical frame portion 24 by means of a threaded support member 28 and a pair of bolts 30. Bolts 30 are mounted through a plate 32 and each extend through parallel slots provided in frame portion 24 such that bolts 30 frictionally engage support frame 26 when tightened.

Threaded support member 28 is received in a threaded bore 34 in the bottom of frame 26 and at the opposite end in a bore 36 in support member 38 and carries a nut 40 which provides a means to raise and lower vertical support frame 26 relative to foot portion 22 of base means 20.

A conventional piston assembly, indicated generally at 42 is conventionally mounted to the upper end of vertical support frame 26 with piston rod 44 extending through a bore 46.

An ink supply station, indicating generally at 48, is mounted to vertical support frame 26 by means of a L-shaped mounting bracket 50 and bolts 52 which are disposed through one of a pair of vertically extending slots provided in bracket 50 for frictional engagement with support frame 26.

Mounting bracket 50 includes a horizontal arm supporting the ink supply pad and reservoir assembly indicated generally at 54.

The assembly 54 includes an outer housing 56, a movably mounted base means provided with a recess functioning as ink reservoir 58 which supports a conventional absorbent ink pad 60.

A threaded adjustment member 65 and ink pad 60 provides adjustment of ink pad reservoir 58 in relation to stamped pad 100 and is locked in position with locking screws 63.

As best seen in FIGS. 1 and 2, ink reservoir 58 provided within housing 56 is communicated in a conventional manner to a source of ink contained in a bottle 59. Preferably, a conventional conduit 61 in the form of an elbow and threaded connector attached to the bottle opening is provided for easy access to change the bottle supply or refill it. Further, it has been found desirable to employ a wick extending from reservoir 58 through the conduit 61 and into the bottle 59 to provide a supply of ink to reservoir 58 in an efficient and reliable manner.

Figure 6:
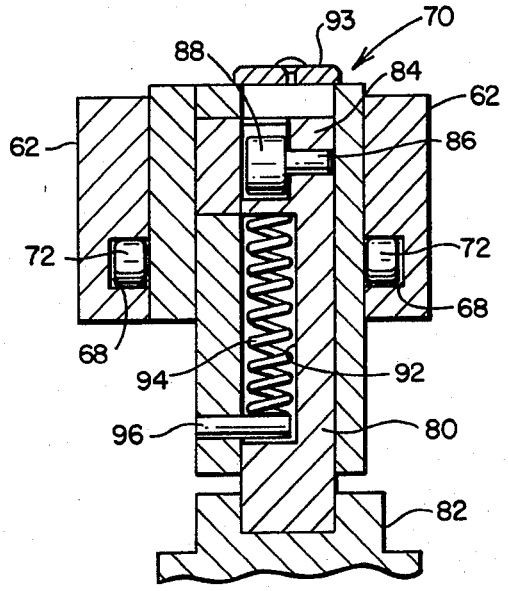
FIG. 6 is a partial side elevational view in section of a portion of the apparatus shown in FIG. 1, the section being taken along line 6—6 in FIG. 1.

Specifically referring to FIGS. 1, 5 and 6, a horizontal disposed housing forms a rail or guide means for the stamping assembly and includes side frame members 62 and end support and stop member 64.

Side frame members 62 are connected at one end to vertical support member 26 by conventional bolts such as 66. End member 64 is conventionally bolted to each side member 62. Each side member 62 is provided with a laterally extending recess 68 which forms a guide track to receive bearing members 72 provided on a sliding T-shaped carriage assembly indicated generally at 70.

A slide block 74 of generally rectangular configuration is threaded fixed to the inner end of piston rod 44 and is slideably received within a mating opening or channel 76 provided in T-shaped carriage 70.

A vertical channel 78 is also provided in carriage assembly 70 and slideably receives the stem or plunger portion 80 which in turn carries the ink stamping platen assembly 82 on its lower end.

Slide block 74 is provided with an opening 85 extending approximately half way through block 74 which is provided with inclined walls 83. The upper end of opening 85 includes a notch 81.

The upper end of stem 80 is provided with a recessed head portion 84 and a pair of inclined walls, such as at 90. A pin 86, carrying a bearing member 88, is mounted through head portion 84 with the bearing 88 extending outward in the recessed portion thereof. Preferably a very slight angular recessed portion is provided on the face of head portion 84 to provide a predetermined clearance to permit the inclined wall surfaces 83 to ride upon the bearing member 88 when head portion 84 is disposed in assembled fashion with pin 86 and bearing 88 extending into opening 83. However, the important consideration is to provide for the inclined plane effect between the walls 83 and bearing 88 on recessed head of stem 80 as will be described in detail later herein.

Stem 80 also includes a vertically extending recess 92 for housing a compression spring 94. The lower end of recess 92 includes an opening to receive a stop pin 96 provided on carriage member 70 which engages the lower end of spring 94 to cause stem 80 to be biased upwardly into channel 78 and toward notch 81.

The upper opening of channel 78 is covered by a plate 93 to prevent inadvertent debris or the like from falling into the opening. Also, optionally, a protective top cover may be provided to enclose the open area between side plates 62 and carriage member 70 for safety purposes.

Referring again to FIG. 5, stem 80 is shown in its depressed position as bearing member rode downwardly along the inclined wall on the right of slide block 74 as viewed in FIG. 5, and piston rod 44 has reached its fully retracted position. Spring 92 is depressed downwardly againt pin 96 and stem 80 is biased upwardly.

Prior to piston rod 44 reaching its fully retracted position, the left end of carriage member 70, engages the face of a stop plate 98 fastened to support frame 26, preventing further travel of carriage 70. Since slide block 74 fully slides within channel 76 of carriage 70, it continues to the left and causes stem 80 to be depressed downwardly upon the forced engagement between the inclined wall of slide block 74 and bearing member 88 on pin 86 which is carried on stem 80.

Upon the return stroke of the piston rod 44, slide block 74 slides within channel 76 to the right and the upward bias of spring 94 causes stem 80 to move upwardly as bearing member 88 slides upwardly along the same inclined wall of block 74.

Figure 3:
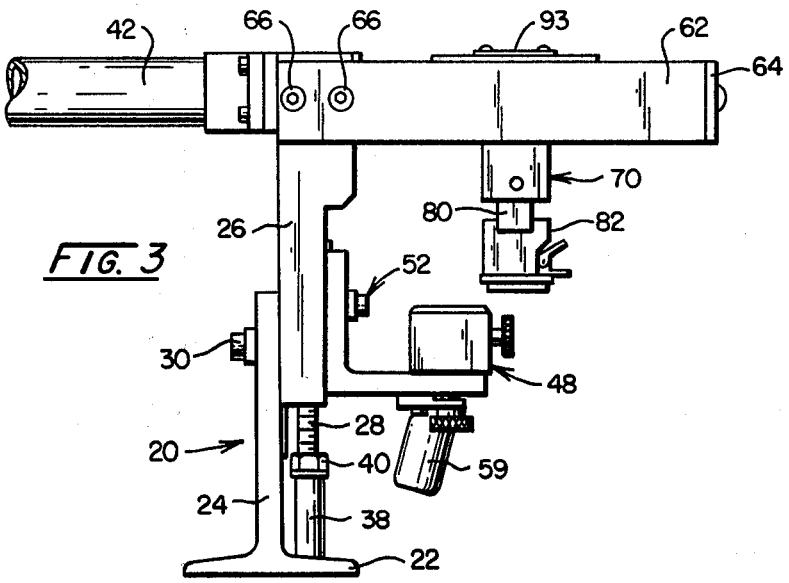
FIG. 3 is a front elevational view similar to that of FIG. 1 illustrating the ink stamping platen assembly horizontally displaced between the inking supply station and the stamping station.

When the upper end of head portion 84 of stem 80 has reached the midpoint of notch 81, continued movement of piston rod 44 to the right, causes carriage member 70, stem 80 and slide block 74 to move to the right, as illustrated in FIG. 3.

At a predetermined position along the extended piston rod stroke, to the right as viewed in FIG. 5, the right end of carriage 70 engages the end closure plate 64 to prevent further movement of carriage 70. This horizontal distance is pre-selected to define the stamping station. As piston rod 44 continues to complete its fully extended stroke, slide block 74, carried on the end of rod 44 continues to move to the right and bearing member 88 engages the left inclined wall surface 83 provided in block 74 which forces stem 80 downwardly against the bias of spring 94. Further horizontal travel of stem 80 is prevented since carriage member 70 is held stationary against further movement by engagement with end plate 64.

Figure 4:
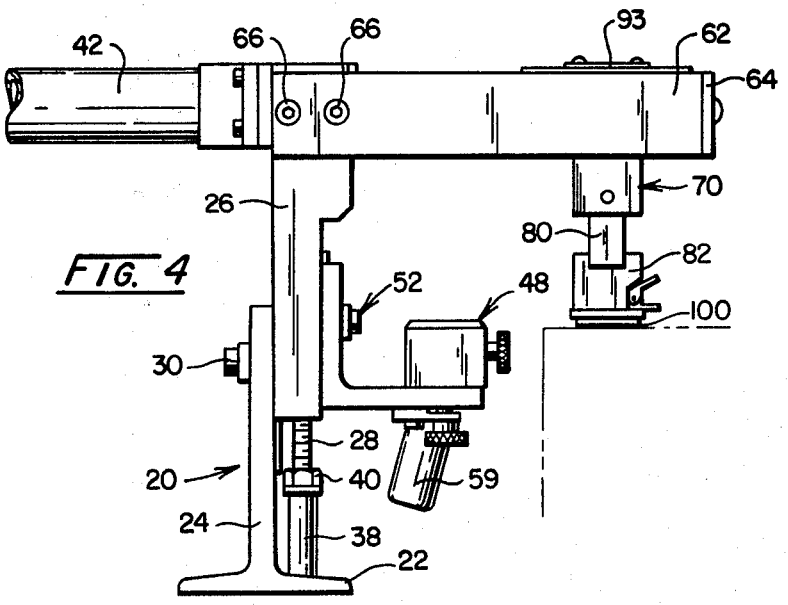
FIG. 4 is a front elevational view similar to FIG. 1 illustrating the ink stamping platen positioned at the ink stamping station.

The stamping platen carrying the removably mounted stamp pad 100, is then caused to forcefully engage the workpiece as shown in FIG. 4. The work piece surface to be stamped is positioned at a predetermined distance from the platen related to a distance less than the full downward stroke of stem 80. Upon the return stroke of rod 44, slide block 74 moves to the left and stem 80 rises due to the bias of spring 94 as bearing member 88 travels along the same left inclined wall surface 83.

As the head portion 84 of stem 80 again reaches the centered position at notch 81, carriage member 70 is pulled horizontally to the left toward the ink supply station wherein stem 80 is depressed downwardly into engagement with inking pad 56 at the ink supply station. Then another piston stroke actuates the repetitive of the cycle as described.

From the foregoing description, it should be readily apparent that the present invention provides a simplified ink stamping apparatus which efficiently moves the stamping platen horizontally along a path between an ink supply station and an ink stamping station using only one horizontally disposed piston which also provides the force to create downward vertical movement of the platen at each station.

In this manner, expense in construction is saved since only one piston and cylinder is required and maintenance and replacement cost is lower than in prior art types which employ additional pistons for the vertical stroke of the ink stamping and supply step.

Also, the use of one horizontally disposed piston in the construction of the present invention permits the apparatus to be constructed with a relatively low vertical profile to more easily fit into assembly or production lines which have limited head room.

The construction of the carriage, slide block and guide rails 68 is also relatively easy and inexpensive to manufacture and requires little maintenance to provide for efficient and reliable service for high volume production.

I claim:

1. In an automatic contact ink stamping apparatus wherein the stamping platen travels between an ink supply station and a stamping station, horizontally spaced from one another, and then vertically at each of said stations to engage an ink supply pad at the ink supply station and a workpiece disposed at said stamping station; the combination of a first member slideably mounted on a frame for horizontal movement between each of said stations; a second member slideably mounted for horizontal travel within said first member and operatively connected to a piston rod having a horizontal forward and return stroke; a stamping platen including an upper elongated stem portion slideably mounted for vertical travel within said carriage member and normally biased into engagement with said second member for horizontal travel as a unit with said first and second members between said stations; means provided on said second member and said stem portion for converting horizontal travel of said second member independent of further travel by said first member into a downward force upon said stem portion to effect a vertically downward displacement of said stamping platen at each of said respective stations.

2. The apparatus defined in claim 1 wherein said last mentioned means include a recessed portion provided on said second member having a pair of downwardly diverging walls and a bearing surface provided on said stem portion normally biased upwardly into a centered position into engagement with the upper portion of said recess, whereby relative movement of said second member within said first member at a terminal portion of each forward and return stroke of said piston causes said bearing surface on said stem to be forced downwardly along one of said diverging walls of said recessed portion and effect a vertically downward displacement of said stamping platen, against said normal bias force urging said stamping platen to return to its original position upon reversal of the stroke of said piston rod.

3. An automatic contact ink stamping apparatus for printing predetermined indicia on a workpiece comprising, in combination, a vertically extending base means supporting a horizontally disposed power cylinder and piston assembly and a horizontally extending carriage housing; said carriage housing including a pair of side walls provided with closures at each end, one of said closures having an opening adapted to slideably receive the inner end of the piston of said cylinder and piston assembly; a generally T-shaped carriage member slideably mounted within said carriage housing between predetermined positions, and including a horizontally extending channel and a vertically extending channel; a slide member slideably disposed within said horizontal channel provided in said carriage member and including a recessed portion having a pair of downwardly diverging walls; a stamping assembly including a lower end provided with a contact ink stamping pad and an upper end provided with an elongated stem slideably mounted within said vertical channel of said carriage means, said elongated stem provided with an upper head portion biased toward a normal uppermost position substantially abutting against the upper most portion of said recessed portion of said slide member and defining a position wherein said slide member, said stamping assembly and said carriage member move horizontally as a unit in the direction of the stroke of said piston, said upper head portion provided with bearing surface means slideably engageable with one of said diverging walls of said recessed portion in said slide member at a terminal portion of the extended and return stroke of said piston upon relative movement of said slide member within said horizontal channel of said carriage member to effect vertical movement of said stem and stamping assembly at a predetermined position along the horizontal travel of said piston.

* * * * *